United States Patent [19]

Benlolo et al.

[11] 4,449,588

[45] May 22, 1984

[54] FIRE EXTINGUISHER MOUNTING UNIT

[76] Inventors: Leon Benlolo, 9370 NW. 13th St., Plantation, Fla. 33322; Carl O. Tolf, Jr., 300 Delnor Ave., St. Charles, Ill. 60174

[21] Appl. No.: 339,853

[22] Filed: Jan. 18, 1982

[51] Int. Cl.[3] ..... A62C 25/00

[52] U.S. Cl. ..... 169/48; 169/51; 312/242; 312/245

[58] Field of Search ..... 169/48, 51; 312/242, 312/245

[56] References Cited

U.S. PATENT DOCUMENTS

| | | | |
|---|---|---|---|
| 2,612,283 | 9/1952 | Cole | 312/242 X |
| 2,686,644 | 8/1954 | Pratt | 312/242 X |
| 3,722,733 | 3/1973 | Neumann | 169/51 X |
| 4,046,439 | 9/1977 | Lee | 312/245 X |
| 4,087,624 | 5/1978 | Hitchcock | 169/48 X |
| 4,244,426 | 1/1981 | Kerr | 169/51 |

*Primary Examiner*—John J. Love
*Assistant Examiner*—Mary F. McCarthy
*Attorney, Agent, or Firm*—Kinzer, Plyer, Dorn & McEachran

[57] ABSTRACT

A fire extinguisher mounting unit includes a cabinet, a frame and an access panel. The cabinet and frame are formed from a flame retardant, high impact plastic with the access panel being formed of a grooved acrylic sheet. The cabinet and frame have cooperating portions which properly position the access panel within the unit, which unit may be mounted either in a recessed position whereby the unit, with the exception of the frame, is recessed into a support, or in a surface position whereby the rear wall of the cabinet is mounted on a support.

2 Claims, 8 Drawing Figures

Fig. 1.
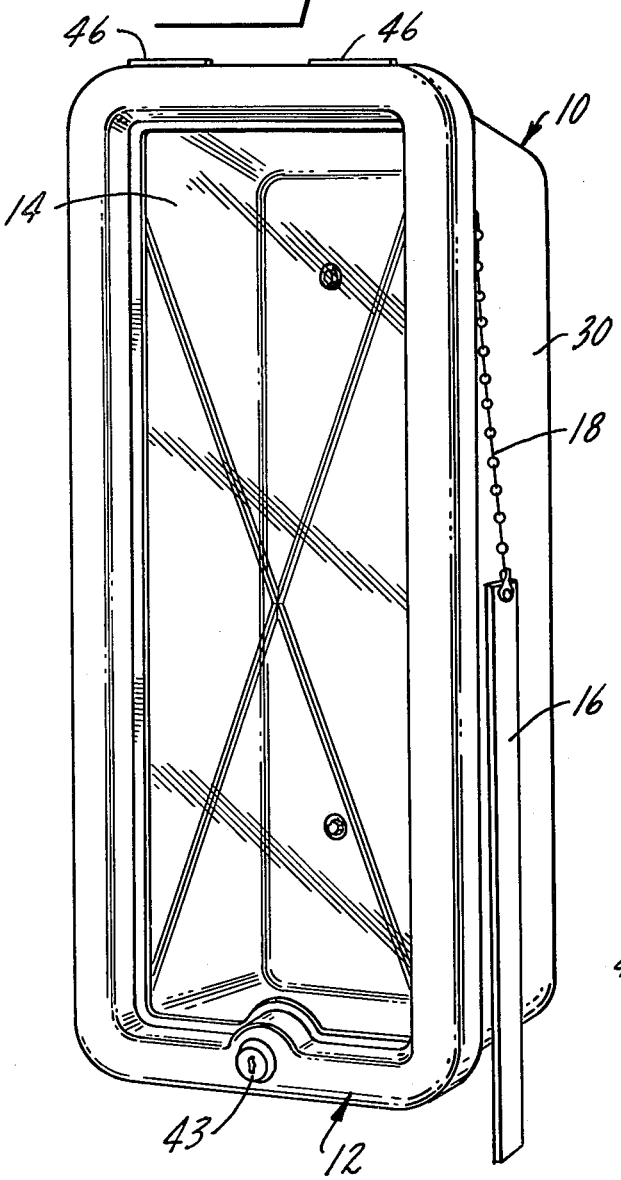
Fig. 2.
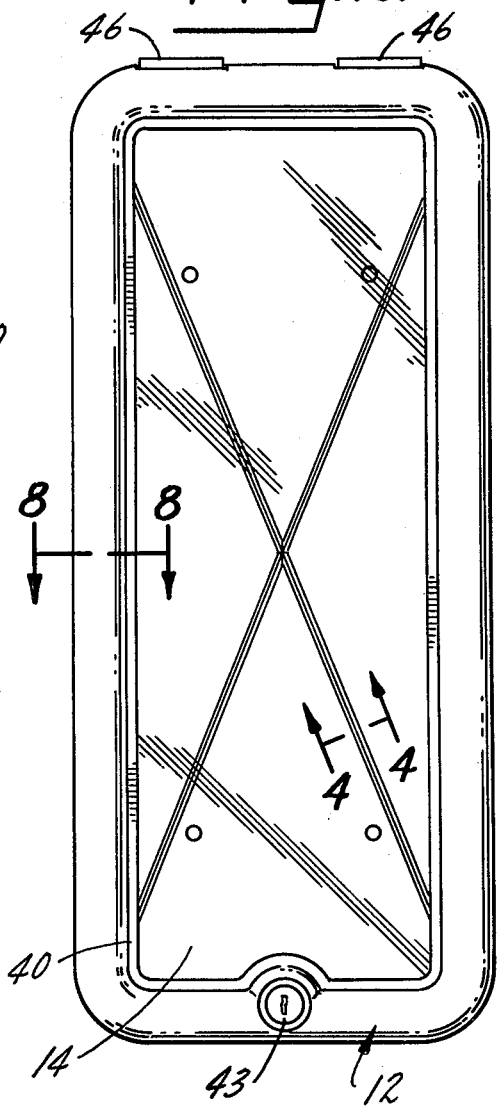
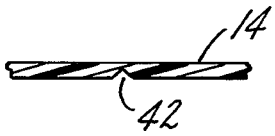
Fig. 4.
Fig. 3.
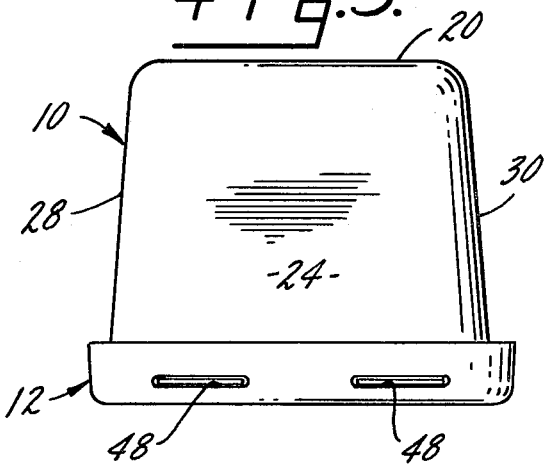

Fig. 5.
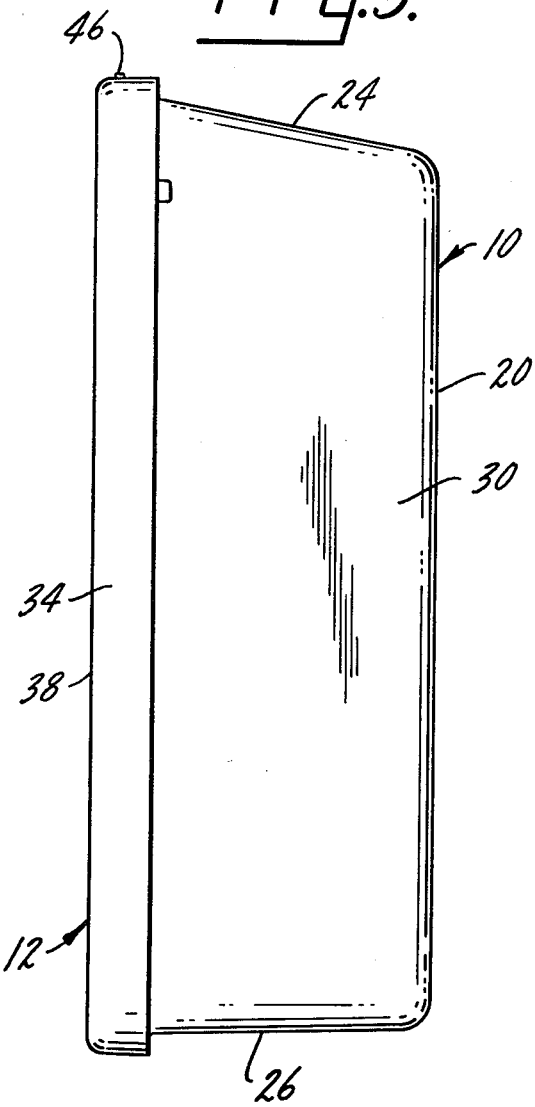
Fig. 6.
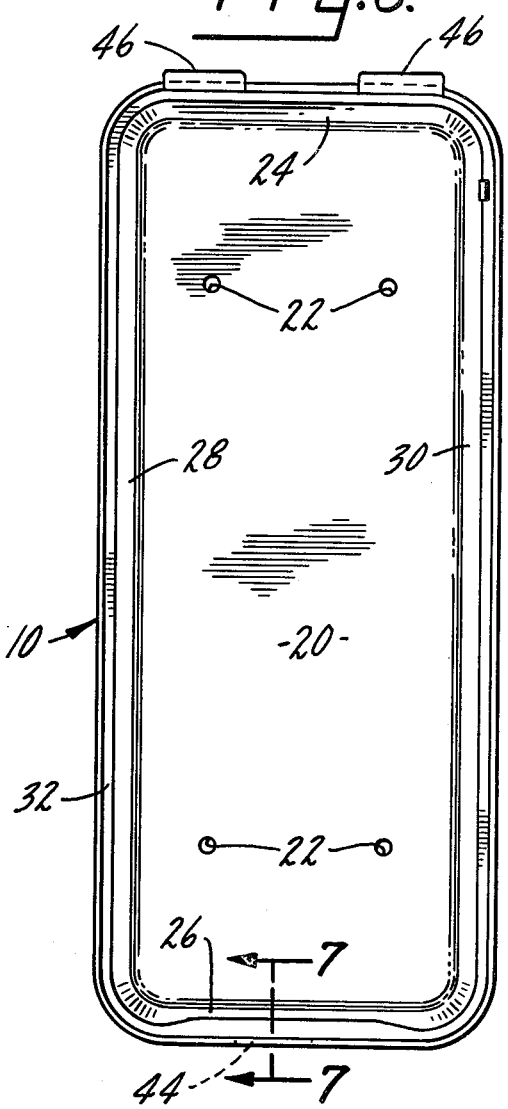
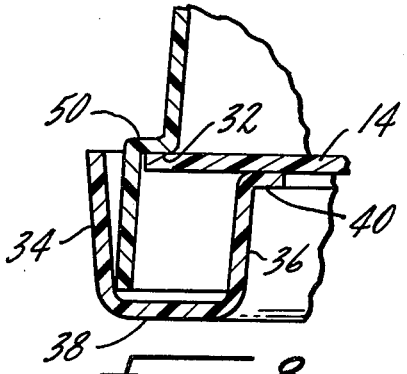
Fig. 8.
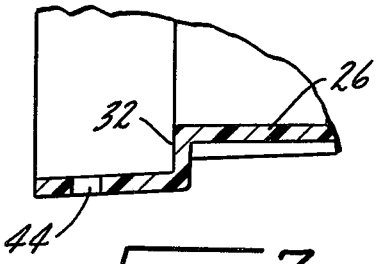
Fig. 7.

FIRE EXTINGUISHER MOUNTING UNIT

SUMMARY OF THE INVENTION

The present invention relates to fire extinguisher cabinets or mounting units and in particular to such a unit which may be either surface or recess mounted.

Another purpose is a fire extinguisher mounting unit which is formed from a flame resistant high impact material.

Another purpose is a fire extinguisher mounting unit of the type described which is light in weight, thereby reducing shipping cost.

Another purpose is a fire extinguisher mounting unit of the type described which is simple in construction and reliable.

Other purposes will appear in the ensuing specification, drawings the claims.

BRIEF DESCRIPTION OF THE DRAWINGS

The invention is illustrated diagrammatically in the following drawings wherein:

FIG. 1 is a front perspective of the fire extinguisher mounting unit described herein, FIG. 2 is a front plan view of the unit of FIG. 1, FIG. 3 is a top end view of the structure in FIGS. 1 and 2, FIG. 4 is a section through the access panel along plane 4—4 of FIG. 2, FIG. 5 is a side view of the unit disclosed herein, FIG. 6 is a front plan view of the mounting cabinet with the frame and access panel removed, FIG. 7 is an enlarged section along plane 7—7 of FIG. 6, and FIG. 8 is an enlarged partial section along plane 8—8 of FIG. 2 illustrating the relative positions of the cabinet, access panel and mounting frame.

DESCRIPTION OF THE PREFERRED EMBODIMENT

The fire extinguisher mounting unit of the present invention comprises essentially three parts. There is a cabinet 10, a frame 12 and an access panel 14. In addition, there is a breaker bar 16 which will be hung by a chain 18 to the cabinet as described.

Looking specifically at cabinet 10, it includes a rear wall 20 which may have four mounting openings 22 usable when the mounting unit is surface mounted to a supporting surface, such as a wall. Integral with rear wall 20 are four side walls, two end walls 24 and 26 and two elongated side walls 28 and 30. Side walls 24–30 are all slightly outwardly tapered relative to rear wall 20 and there is an offset ledge 32 formed adjacent to but spaced from the outer end of the described side walls.

The cabinet as well as frame 12 may be formed of a suitable high impact flame retardant plastic, such as the product known as ABS, and it may include in the molding process suitable material stabilizers and ultraviolet inhibitors for protection against fading from natural or artificial light. The cabinet and frame are essentially indestructable in normal handling and usage because of the particular material selected. In this connection, it should also be noted that the junctions between side walls and between any one of the side walls and the rear wall are substantially rounded, thus eliminating sharp corners which may cause injury.

Frame 12 has a generally U-shaped cross section as particularly illustrated in FIG. 8. There are side walls 34 and 36 and an end wall 38 which forms the bottom of the U. Walls 34 and 36 slightly diverge and when in the completely assembled position of FIG. 8 the ends of side walls 24–30 will extend substantially the entire distance into the open frame. Inner side wall 36 has an inwardly-extending flat portion 40 which along with ledge 32 defines the support surfaces for the access panel.

Access panel 14 which may preferably be formed of a clear shatterproof acrylic sheet rather than glasss has, as particularly illustrated in FIG. 4, inwardly-directed grooves 42 which are on the interior side of the sheet and the grooves may be formed in a cross or X, although this is not essential. When in the fully assembled position, as illustrated in FIG. 8, the interior surface of ledge 32 supports one side of the access panel 14 and the interior surface of inwardly-extending portion 40 supports the other side of the access panel. Thus, the distance between the ledge and inwardly-extending portion 40 is essentially equal to the thickness of the access panel and the access panel will be tightly and securely held in position when the unit is full assembled.

One end of frame 12 may include a lock 43 which is preassembled, enabling the user to reduce installation time. As particularly shown in FIGS. 6 and 7, there is a slot 44 in end wall 26 which provides an opening for the locking member of lock 43, which slot is hidden by the frame once the unit is assembled. Thus, the locking element and the slot through which it moves are hidden and not visible from the outside once the unit is fully assembled and mounted. End wall 24 of cabinet 10 may have spaced outwardly-extending projections 46 (FIG. 6) which will cooperate with interlocking slots 48 in the frame (FIG. 3) to secure the frame upon the cabinet.

The unit may either be surface mounted or recess mounted. When it is surface mounted holes 22 in cabinet 10 provide the means for mounting the unit to a supporting surface. When the unit is recess mounted, the exterior surface 50 of peripherally-extending offset ledge 32 provides the mounting surface. Surface 50 is positioned against a support and the only portion of the entire unit which extends outside of an opening or the recess in the support is the frame itself.

Whereas the preferred form of the invention has been shown and described herein, it should be realized that there may be many modifications and substitutions thereto.

The embodiments of the invention in which an exclusive property or privilege is claimed are defined as follows:

1. A fire extingusher mounting unit including a cabinet, a frame and an access panel, said cabinet and frame being formed from a flame retardant, high impact plastic with said access panel being formed of a grooved acrylic sheet, said cabinet being generally rectangular and having a rear wall and four tapered side walls integral therewith, each of said side walls having an offset ledge remote from the rear wall thereof, with the interior surface of said ledge being generally continuous and providing a support for mounting said access panel, said frame having a generally U-shaped cross section with the outer edge of said side walls extending into the open side of said frame generally the entire depth of said generally U-shaped cross section frame when the frame is mounted upon said access panel and cabinet, the interior wall of said frame having an inwardly-extending flat portion which is positioned against the exterior of said access panel with the interior surface of said ledge and the inward side of said frame inwardly-extending flat portion being spaced apart a distance generally equal to the thickness of said access panel whereby the access panel is held between said inwardly-extending flat portion and said offset ledge, said cabinet being mountable either with the rear wall positioned against a support or recessed whereby the exterior of said offset ledge is peripherally positioned against a support.

2. The fire extinguisher mounting unit of claim 1 further characterized in that said access panel has interiorly opening grooves, generally diagonally disposed therein.

* * * * *